US010823164B2

(12) United States Patent
Sauer

(10) Patent No.: US 10,823,164 B2
(45) Date of Patent: Nov. 3, 2020

(54) DIAPHRAGM PUMP FOR DOSING A FLUID CAPABLE OF AUTOMATIC DEGASSING AND AN ACCORDING METHOD

(75) Inventor: Wolfgang Sauer, Bischofswiesen (DE)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 14/240,901

(22) PCT Filed: Aug. 25, 2011

(86) PCT No.: PCT/EP2011/064611

§ 371 (c)(1),
(2), (4) Date: Jun. 25, 2014

(87) PCT Pub. No.: WO2013/026485

PCT Pub. Date: Feb. 28, 2013

(65) Prior Publication Data

US 2015/0167659 A1 Jun. 18, 2015

(51) Int. Cl.

| | |
|---|---|
| ***F04B 43/04*** | (2006.01) |
| ***F04B 43/02*** | (2006.01) |
| ***F04B 43/00*** | (2006.01) |
| ***F04B 49/06*** | (2006.01) |

(52) U.S. Cl.

CPC ..... *F04B 43/04* (2013.01); *F04B 43/0081* (2013.01); *F04B 43/02* (2013.01); *F04B 49/06* (2013.01); *F04B 2205/503* (2013.01)

(58) Field of Classification Search

CPC ..... F04B 13/00; F04B 43/02; F04B 43/04; F04B 43/043; F04B 2205/50; F04B 2205/501; F04B 2205/503; F04B 45/04; F04B 45/047; F04B 49/10; F04B 49/22; F04B 49/06; F04B 43/0081

USPC ..... 73/19.02–19.04

See application file for complete search history.

(56) References Cited

U.S. PATENT DOCUMENTS 3,114,257 A * 12/1963 Foster ..... G01F 1/00 324/675
3,898,637 A * 8/1975 Wolstenholme ..... F17D 3/01 128/DIG. 13
4,410,322 A * 10/1983 Archibald ..... A61M 5/14224 138/30
5,349,852 A 9/1994 Kamen et al.

(Continued)

FOREIGN PATENT DOCUMENTS

AU 635262 B2 * 3/1993 ..... A61M 5/14224
EP 0168656 A1 * 1/1986 ..... F04B 53/06

(Continued)

OTHER PUBLICATIONS

International Patent Application No. PCT/EP2011/064611, International Search Report and Written Opinion dated Jul. 23, 2012, 10 pages.

*Primary Examiner* — Patrick Hamo
*Assistant Examiner* — Chirag Jariwala
(74) *Attorney, Agent, or Firm* — Fredrikson & Byron, P.A.

(57) ABSTRACT

A diaphragm pump, in particular for use as a detergent dosage pump, comprises a pump head, a fluid chamber adjacent to the pump head, a diaphragm defining a wall of the fluid chamber and reciprocatingly movable, at least a suction check valve and a dosing check valve, a control unit, and a detector unit for detecting a fluid inside the fluid chamber. The diaphragm pump according to the invention offers increased process reliability.

20 Claims, 3 Drawing Sheets

(56) References Cited

U.S. PATENT DOCUMENTS

| | | | | |
|---|---|---|---|---|
| 5,455,565 | A * | 10/1995 | Moeenziai | G01N 29/036 340/603 |
| 5,769,608 | A | 6/1998 | Seale | |
| 6,280,408 | B1 * | 8/2001 | Sipin | A61M 5/1483 604/65 |
| 6,416,293 | B1 | 7/2002 | Bouchard et al. | |
| 6,764,212 | B1 * | 7/2004 | Nitta | B01F 5/0471 366/114 |
| 7,201,097 | B2 * | 4/2007 | De Koning | F04B 43/0009 417/413.1 |
| 7,403,125 | B2 * | 7/2008 | Rich | G01N 15/1404 141/94 |
| 8,215,930 | B2 * | 7/2012 | Burden | F04B 15/02 417/413.1 |
| 2003/0217962 | A1 | 11/2003 | Childers et al. | |
| 2004/0062662 | A1 * | 4/2004 | Claude | F04B 13/00 417/290 |
| 2004/0226346 | A1 * | 11/2004 | Schluecker | F04B 51/00 73/46 |
| 2007/0031271 | A1 * | 2/2007 | Claude | F04B 13/00 417/440 |
| 2009/0319204 | A1 * | 12/2009 | Brown | A61M 5/365 702/47 |
| 2010/0160137 | A1 | 6/2010 | Scibona et al. | |
| 2010/0232995 | A1 * | 9/2010 | Claude | F04B 13/00 417/440 |
| 2013/0112080 | A1 * | 5/2013 | Piper | B01D 19/0036 96/155 |

FOREIGN PATENT DOCUMENTS

| | | | | |
|---|---|---|---|---|
| WO | 0118395 | A1 | 3/2001 | |
| WO | WO 03024555 | A2 * | 3/2003 | F04B 49/022 |

* cited by examiner

DIAPHRAGM PUMP FOR DOSING A FLUID CAPABLE OF AUTOMATIC DEGASSING AND AN ACCORDING METHOD

TECHNICAL FIELD OF THE INVENTION

The present invention relates to a diaphragm pump, in particular for use as a detergent dosage pump, capable of automatic degassing and an according method.

BACKGROUND OF THE INVENTION

Diaphragm and piston pumps are used to supply metered quantities of liquids with various properties. Depending on the field of application, the pump behaviour is subject to various requirements in order to ensure that the delivered quantity of the metered medium is as precise as possible and remains constant for as long as possible.

Diaphragm pumps are common industrial pumps that use positive displacement to move liquids. These devices typically include a single diaphragm and chamber, as well as a dosing check valves to prevent back-flow. Pistons are either coupled to the diaphragm or used to force hydraulic oil to drive the diaphragm. Diaphragm pumps are normally highly reliable because they do not include internal parts that rub against each other. Diaphragm pumps can handle a range of media that includes abrasive materials, acids, chemicals, or the like since the drive means is normally completely separated from hydraulic part of the pump. Since diaphragm pumps can deliver small volumes of fluid with the maximum discharge, they are especially suitable as dosage pumps.

Another reason for using diaphragm pumps as dosage pumps is that these pumps have two strokes, i.e. an aspiration stroke in which the medium is aspirated from a reservoir and a compression stroke or delivery stroke where delivery of the metered medium e. g. into a metered line takes place. Known diaphragm pumps, for instance, comprise suction check valves as well as dosing check valves to prevent back-flow. These check valves are usually spring biased and are opened and closed by the pressure difference of the medium to be pumped. The check valves are normally only operated by the differential pressure of the fluid. In case of a gas trapped inside the diaphragm pump the pump may cease to function as the trapped air is compressed by the positive displacement of the diaphragm rather than being pushed out through the dosing check valve. Hence diaphragm pumps need to be monitored and degassed in order to avoid a decrease in the process reliability of the diaphragm pump.

It is therefore an object of the present invention to provide an improved diaphragm pump which offers increased process reliability.

SUMMERY OF THE INVENTION

This object is solved by means of a diaphragm pump for dosing fluids, in particular for use as a detergent dosage pump, having the features of claim 1 and by means of a method for detecting a fluid, in particular a gas, inside a diaphragm pump, in particular inside the fluid chamber of a diaphragm pump, having the features of claim 8. Preferred embodiments, additional details, features, characteristics and advantages of the object of the invention of said diaphragm pump and said method are disclosed in the subclaims.

In a general aspect of the invention the diaphragm pump, in particular for use as a detergent dosage pump, comprises a pump head, a fluid chamber adjacent to the pump head, a diaphragm defining a wall of the fluid chamber and reciprocatingly movable by a driving means, at least a suction check valve and a dosing check valve, a control unit, and a detector unit for detecting a fluid inside the fluid chamber.

The diaphragm pump may be used as a detergent dosage pump, wherein the detergents may be any liquid, in particular acids or bases. The pumping head may accommodate a fluid chamber. A diaphragm defines a wall of the fluid chamber and is reciprocatingly movable in order to suck a fluid into the fluid chamber, for example during a suction cycle, and to expel the fluid at least partially from the fluid chamber, during a dosing cycle for example, by a positive movement of the diaphragm towards the pump head. The diaphragm pump comprises at least one suction check valve, opening during the suction cycle and blocking during the dosing cycle, and at least one dosing check valve, blocking during the suction cycle and opening during the dosing cycle. A control unit is provided in order to control the operating of the diaphragm pump, in particular of a driving means of the diaphragm pump. A detector unit is provided for detecting a fluid inside the fluid chamber of the diaphragm pump. The fluid may be for example a liquid, a detergent for example, a gas, for example an outgassed liquid and/or air, or a liquid comprising a gas. The detector unit may be positioned inside the pump head in order to monitor in particular areas inside the fluid chamber where a gas will start to collect, for example clearance volumes. This enables a timely detection of a gas build-up allowing for a timely degassing of the fluid chamber. The detector unit may be located adjacent to the fluid chamber without physically contacting the fluid inside the fluid chamber. The detector unit may send a signal to the control unit, for example that a gas is building up inside the fluid chamber so that the control unit may stop the driving means and for example indicated the need for degassing, for example by opening a bypass in order to degas the fluid chamber. The gas from the fluid chamber may be directed back to a fluid reservoir.

The diaphragm pump according to the present invention has a few advantages over devices according to the state of the art. For example, the contactless detecting of a gas directly inside the fluid chamber increases the reliability of the detector unit. Further it is possible to detect a gas or a gas build-up directly inside the fluid chamber allowing for a timely degassing of the fluid chamber prior to a failure of the diaphragm pump due to a gas build-up. Further it is possible to detect that a fluid, a liquid detergent product for example, has run out, for example when a product reservoir has been completely pumped empty. This allows the full use of a product reservoir, thus increasing the cost efficiency of the process.

In another embodiment of the invention the detector unit comprises at least a first oscillator means with a first sensor element and a comparator means for measuring the frequency of the first oscillator means, wherein a frequency of the oscillator means is affected at least by a dielectric constant of a fluid inside the fluid chamber. The oscillator means may be configured as a free-running oscillator. The frequency of the oscillator means may also be affected by the amount of fluid inside the fluid chamber. Due to the changing volume of fluid inside the fluid chamber during a dosing and/or suction cycle the frequency measured by the comparator means may change periodically. The frequency may for example change periodically between a fluid or liquid specific first value at the beginning of the suction cycle and a second value at the end of the suction cycle. The first oscillator means is electrically connected to the first sensor element and the comparator means and may be electrically connected to the control unit. The first sensor element may be arranged inside the pump head adjacent to the surface of the pump facing the fluid chamber for a contactless measurement of the fluid. The first sensor element may be located inside the pump head adjacent to the suction check valve or the dosing check valve, for example in order to detect a gas entering the fluid chamber.

In another preferred embodiment of the invention the first sensor element is designed as a pair of electrodes for generating an electrical field at least partially inside the fluid chamber. The electrodes may be of a plan shape and may be arranged inside the pump head, basically parallel to the surface of the pump head facing the fluid chamber, for contactless detecting of a gas inside the fluid chamber. The first sensor element may be configured to generate an electric field at least partially inside at least a part of the fluid chamber. The first sensor element is a capacitance based sensor element, affecting the frequency of the oscillator means. The capacitance of the first sensor element may be a function of the relative dielectric constants for different fluids, for a liquid and/or a gas for example. Based on the different dielectric constants and/or the amount of fluid present, the first sensor element provides a different capacitance for each fluid and thus altering the frequency of the oscillator means, a free-running oscillator for example, accordingly. Thus a contactless detection of a fluid, for example a gas, inside the fluid chamber is possible.

In a particularly preferred embodiment of the invention the comparator means comprises a storage means. The storage means may be configured to store measured frequencies, for example of the first oscillator means. The storage means may also be configured to store predefined frequencies, for example of one or more specific fluids, in order to enable a comparison of measured frequencies, for example of the first oscillator means, with predefined frequencies. This increases the accuracy of detecting a gas build up inside the fluid chamber.

Furthermore, in a preferred embodiment of the invention the detector unit comprises a second oscillator means with a second sensor element. The second oscillator means may generate an electrical field at least partially inside at least a part of the fluid chamber for detecting a fluid. The second oscillator means may comprise a second sensor element, for example a capacitance based sensor element in form of a pair of electrodes. The frequency of the second oscillator means may be measured by the comparator means and/or stored inside a storage means. The second sensor elements may be located at a different areas inside the pump head as the first sensor element in order to monitor two defined areas inside the fluid chamber and/or adjacent to the check valves. This has the advantage that for example a gas build up as well as a run out fluid, product, may be detected.

In a further preferred embodiment of the invention the detector unit is at least partially formed as an integral part of the control unit. The comparator means and/or the storage means may be formed as an integral part of the control unit. Further, the oscillator means may be at least partially integrated into the control unit, for example the oscillator means apart from the sensor element. This enables a compact and cost efficient design of the diaphragm pump.

In a further preferred embodiment of the invention a degassing valve connected to the fluid chamber (18) is provided. The degassing valve may be located at and/or connected to the highest point of the fluid chamber in an operating position, for example where a gas will start to collect. The degassing valve may be electrically operable. The degassing valve may be controllable by the control unit, depending on a gas build up in the fluid chamber. Thus it is possible to, in particular automatically, degas the fluid chamber. In particular an automatically operated degassing valve may enhance the self priming capability of the diaphragm pump, especially as this may be done without the need for a manual operation.

A further aspect of the present invention is a method for detecting gas inside a diaphragm pump, in particular inside the fluid chamber of a diaphragm pump, comprising the steps of:

- providing a diaphragm pump according to the above described diaphragm pump,
- starting a dosing cycle by dosing at least part of the fluid inside of the fluid chamber,
- starting a suction cycle, preferably after at least partly dosing the fluid,
- monitoring the fluid chamber by measuring of the frequency of the at least first oscillator means, and if detected, indicating of a gas build up inside the fluid chamber.

The diaphragm pump may start with either a dosing cycle or a suction cycle on power up. In a dosing cycle for example the fluid inside the fluid chamber is expelled through the for example second check valve from the fluid chamber by a dosing movement of the diaphragm. During the dosing cycle at least a part of the fluid inside the fluid chamber is expelled and/or dosed. An at least partially empty fluid chamber may, for example after a dosing cycle, be filled by starting a suction cycle in order to suck fluid into the fluid chamber through for example the first check valve, wherein the diaphragm moves outwards thus increasing the volume of the fluid chamber. The dosing cycle and suction cycle may be repeated over and again depending on the amount of fluid to be dosed.

The fluid chamber is monitored, for example constantly, in order to enable a timely indicating of a gas build up inside of the fluid chamber. This allows for a timely degassing and thus increases the process reliability of the diaphragm pump. The fluid chamber is monitored by a measuring the frequency of at least a first free running oscillator means, whose frequency may be altered due to a capacitance based sensor element, for example a pair of electrodes generating an electrical field in at least a part of the fluid chamber. A fluid, for example a liquid in form of a detergent, chamber comprises a specific dielectric constant. Depending on the dielectric constant the capacitance of the for example first sensor element is altered and thus the frequency of the oscillator means changed. The frequency change may depend on the dielectric constant of the fluid and/or on the amount of fluid present inside the fluid chamber. Thus, the frequency may vary periodically, wherein the periodic frequency change may be related to the dosing and/or suction cycle of the diaphragm pump.

The frequency is measured by the comparator means and for example if a frequency change occurs faster than during the normal periodic changing of the frequency during operating the diaphragm pump, a gas build up may be detected, as the frequency of the oscillator means for a gas is significantly different, for example about twice as high, to the frequency of a liquid. If a gas build up inside the fluid chamber is detected, a detection signal may be sent from for example from the comparator means to the control unit, which may indicate the need for degassing and optionally stop the driving means operating the diaphragm, enabling a timely degassing of the diaphragm pump. This contactless detecting of a gas build up inside the fluid chamber increases the process reliability of the diaphragm pump significantly.

In a preferred embodiment the method further comprises the step of comparing the measured frequency with predefined threshold frequencies. The frequency of the oscillator means and the periodic frequency change during a dosing and/or suction cycle of the diaphragm pump may be fluid, in particular liquid, specific. For a given liquid, for example a detergent, which is to be dosed with the diaphragm pump, predefined threshold frequencies may be defined and for example stored in a comparator means, in particular a storage means. The threshold frequencies may define a lower and/or an upper threshold for the measured frequency of the oscillator means. The periodically changing measured frequency of the oscillator means may be monitored by the comparator means and constantly compared to the threshold frequencies. If the measured frequency of the oscillator means crosses the predefined threshold frequencies, this may be due to a gas build up inside the fluid chamber. Thus, the comparator means may send an according signal to the control unit, which then may indicate the need for degassing the fluid chamber.

In a particularly preferred embodiment of the method the detector unit is configured in a self learning way. The detector unit, in particular the comparator means, may start with measuring the frequency of the oscillator means for example for a full dosing and/or suction cycle of the diaphragm pump. The comparator means may store the initially measured periodically changing frequency for example as comparison frequency. The comparator may define threshold frequencies depending on the measured frequencies and/or the stored comparison frequencies for detecting a gas build up inside the fluid chamber, when a sudden aberration from the measured and/or defined frequencies occurs. This has the advantage, that the diaphragm pump may be self gauging, thus reducing the fabrication tolerances and the need for a manual gauging of the diaphragm pump.

In a more preferred embodiment the method further comprises the steps of measuring the frequency of a second oscillator means, and in particular storing the measured frequency of the second oscillator means as a reference frequency. The second oscillator means may comprise a second sensor element which may be located close to the check valve allowing the fluid to enter the fluid chamber. After power up of the diaphragm pump the second oscillator means may provide a reference frequency once the fluid starts to enter the fluid chamber, wherein the reference frequency depends on the dielectric constant and/or the amount of the fluid. Depending on the reference frequency a set of predefined threshold frequencies may be automatically chosen, for example by the comparator means, in order to monitor and compare the frequency of the oscillator means and to timely detect a gas build up inside the fluid chamber.

In a particularly preferred embodiment of the method a degassing valve is operated by the control unit. For example after a product reservoir has been completely pumped empty, after replacing the fluid reservoir the diaphragm pump is capable of automatically degassing the fluid reservoir, enhancing the self priming capability of the diaphragm pump, especially as this may be done automatically without the need for a manual operation. This allows for an efficient degassing process and increases the process reliability of the diaphragm pump.

DESCRIPTION OF THE FIGURES

Additional details, features, characteristics and advantages of the object of the invention are disclosed in the figures and the following description of the respective figures, which—in exemplary fashion—show one embodiment and an example of a dispensing system according to the invention. In the drawings:

The illustration in FIGS. 1A and 1B show an embodiment of the present invention. In FIG. 1B a diaphragm pump 10 is shown. The diaphragm pump 10 comprises a pump head 12 with channels leading to a suction check valve 14, opening during a suction cycle and blocking during a dosing cycle, and a dosing check valve 16, blocking during a suction cycle and opening during a dosing cycle. In the pump head 12 a fluid chamber 18 is arranged, with one wall being defined by a diaphragm 20. The diaphragm is reciprocatingly moveable by a driving means (not shown) via a con rod 22, which is attached to the diaphragm 20. Inside the pump head 12 a first sensor element 24 is located adjacent to the surface of the pump head 12 next to the fluid chamber 18 and in the direction of the dosing check valve 16. The first sensor element 24 comprises two plane electrodes 26 for contactless detecting a gas inside the fluid chamber 18. The first sensor element 24 is a capacitance based sensor element of a first oscillator means (not shown). Depending on the dielectric constant and/or the amount of fluid, in particular liquid, inside the fluid chamber 18, the frequency of the first oscillator means varies and may change periodically according to a dosing and/or suction cycle of the diaphragm pump 10. The electrodes 26 generate an electrical field 28, which reaches at least partially into the fluid chamber 18. Hence a gas can be detected inside the fluid chamber 18, in particular in the area of the electric field 28 inside the fluid chamber 18, when a sudden, not periodic, change in frequency occurs.

In FIG. 2 a diagram of a measured frequency of the oscillator means is shown, wherein the frequency of about 173 kHz comprises a square wave form, corresponding to a liquid present inside for example the fluid chamber 18. The measured frequency of the oscillator means shown in FIG. 3 also comprises a square wave form but with a frequency of about 287 kHz, corresponding to air present for example inside the fluid chamber 18. Thus, when a gas builds up inside the fluid chamber a significant difference in the frequency is provided and this significant difference may be detected by a comparator means, in particular by comparing the measured frequency to threshold frequencies, and may thus be used for detecting a gas inside the fluid chamber.

Figure 1A:
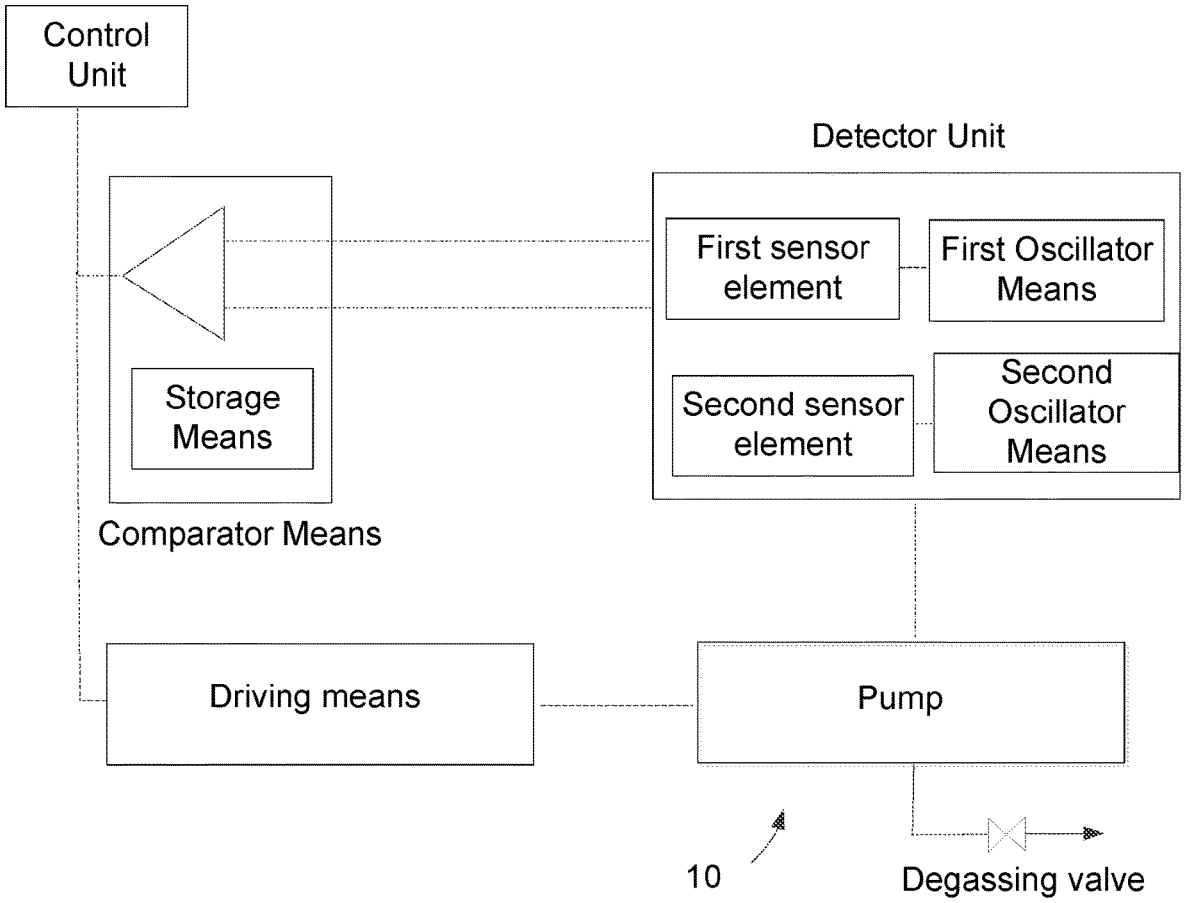
FIG. 1A shows a block diagram of a diaphragm pump according to an embodiment.
Figure 1B:
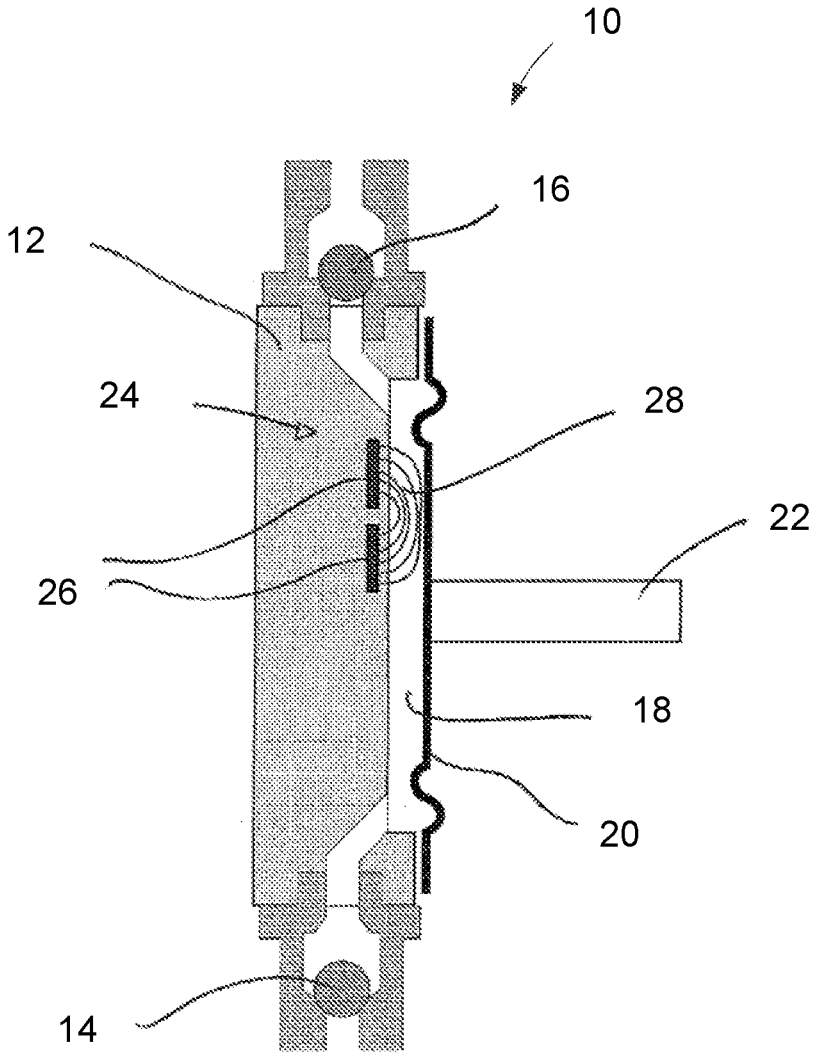
FIG. 1B shows a schematically illustration of a diaphragm pump according to the present invention
Figure 2:
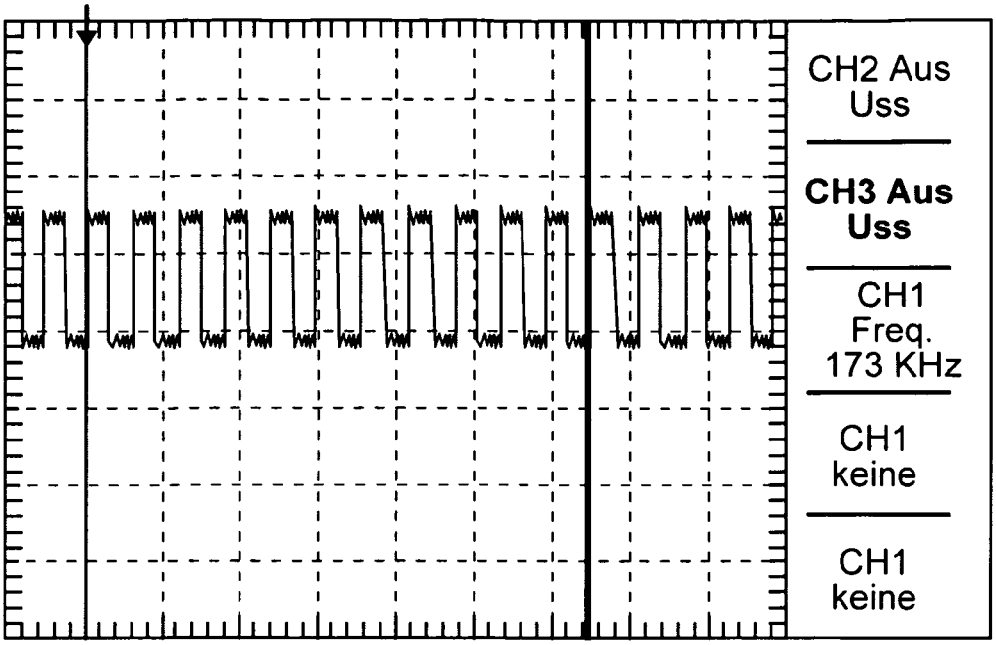
FIG. 2 shows an example of an altered frequency for a fluid inside the fluid chamber.
Figure 3:
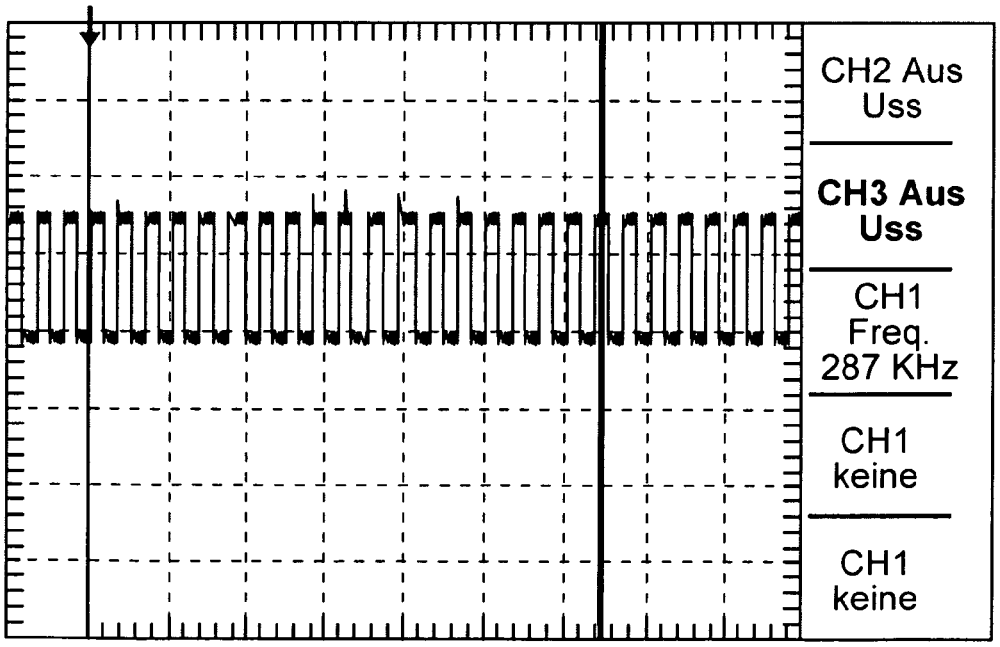
FIG. 3 shows an example of an altered frequency for a gas present inside the fluid chamber.

The particular combinations of elements and features in the above detailed embodiments are exemplary only; the interchanging and substitution of these teachings with other teachings in this and the patents/applications incorporate by reference are also expressly contemplated. As those skilled in the art will recognize, variations, modifications, and other implementations of what is described herein can occur to those of ordinary skill in the art without departing from the spirit and the scope of the invention as claimed. Accordingly, the foregoing description is by the way of example only and is not intending as limiting. In the claims, the wording "comprising" does not exclude other elements or steps, and the identified article "a" or "an" does not exclude a plurality. The mere fact that certain measures are recited in mutually different dependent claims does not indicate that a combination of these measures cannot be used to advantage. The inventions scope is defined in the following claims and the equivalents thereto. Furthermore, reference signs used in the description and claims do not limit the scope of the invention as claimed.

LIST OF REFERENCE SIGNS

10 diaphragm pump
12 pump head
14 suction check valve
16 dosage check valve
18 fluid chamber
20 diaphragm
22 con rod
24 first sensor element
26 electrode
28 electric field

The invention claimed is:

1. A diaphragm pump, for use as a detergent dosage pump, comprising:
- a pump housing, the pump housing comprising a rigid wall and a flexible wall;
- a fluid chamber defined within the pump housing between the rigid wall and the flexible wall and having a fluid path inside the fluid chamber;
- a diaphragm defining the flexible wall of the fluid chamber, the diaphragm being reciprocatingly movable; and
- a detector unit for detecting a fluid inside the fluid chamber, the detector unit comprising:
  - a pair of electrodes located outside the fluid chamber, thereby outside the fluid path inside the fluid chamber, and being positioned within the pump housing proximate the rigid wall and closer to the rigid wall than the flexible wall, and the pair of electrodes generating an electric field inside the fluid chamber and the fluid inside the fluid chamber functioning as a dielectric separating the pair of electrodes;
  - a first oscillator connected to the pair of electrodes and having an oscillation frequency, the oscillation frequency of the first oscillator being affected by a dielectric constant of the fluid inside the fluid chamber functioning as the dielectric separating the pair of electrodes.

2. The diaphragm pump according to claim 1, further comprising at least one suction check valve and a dosing check valve.

3. The diaphragm pump according to claim 1, wherein the diaphragm is reciprocatingly movable by a driver.

4. The diaphragm pump according to claim 1, wherein the detector unit is configured to send a signal to stop the diaphragm from moving when a gas build-up is detected in the fluid chamber by the detector unit.

5. The diaphragm pump according to claim 1, wherein the detector unit comprises a second oscillator with a sensor element.

6. The diaphragm pump according to claim 1, wherein the pair of electrodes located outside the fluid chamber do not interfere with the flexure of the flexible wall.

7. The diaphragm pump according to claim 1, wherein a degassing valve connected to the fluid chamber is provided.

8. The diaphragm pump according to claim 1, wherein the pair of electrodes comprises a first electrode and a second electrode, and the pair of electrodes are positioned such that the electric field extends from the first electrode through a first portion of the rigid wall, from the first portion of the rigid wall through the fluid chamber, from the fluid chamber through a second portion of the rigid wall, and from the second portion of the rigid wall to the second electrode.

9. The diaphragm pump according to claim 1, wherein the diaphragm pump further comprises a comparator for comparing a frequency of the first oscillator to predefined threshold frequencies; and the frequency of the first oscillator is affected at least by the dielectric constant of the fluid inside the fluid chamber.

10. The diaphragm pump according to claim 9, wherein the comparator comprises a storage.

11. The diaphragm pump according to claim 9, wherein the comparator measures a frequency corresponding to at least one of (i) a volume of the fluid present in the fluid chamber and (ii) the dielectric constant of the fluid present in the fluid chamber.

12. The diaphragm pump according to claim 9, wherein if the predefined threshold frequencies define a lower threshold and/or an upper threshold for the measured frequency of the first oscillator; and if the measured frequency of the first oscillator is outside the lower threshold and/or upper threshold, the comparator sends a detection signal to a controller, the detection signal indicative of a need for degassing the fluid chamber.

13. A method for detecting gas inside a fluid chamber of a diaphragm pump, comprising the steps of:
- providing the diaphragm pump for use as a detergent dosage pump, comprising:
  - a pump housing, the pump housing comprising a rigid wall and a flexible wall;
  - the fluid chamber defined within the pump housing between the rigid wall and the flexible wall and having a fluid path inside the fluid chamber;
  - a diaphragm defining the flexible wall of the fluid chamber and reciprocatingly movable;
  - a suction check valve;
  - a dosing check valve; and
  - a detector unit for detecting a fluid inside the fluid chamber, the detector unit comprising:
    - a pair of electrodes located outside the fluid chamber, thereby outside the fluid path inside the fluid chamber, and being positioned within the pump housing proximate the rigid wall and closer to the rigid wall than the flexible wall, and the pair of electrodes generating an electric field inside the fluid chamber and the fluid inside the fluid chamber functioning as a dielectric separating the pair of electrodes;
    - a first oscillator connected to the pair of electrodes and having an oscillation frequency, the oscillation frequency of the first oscillator being affected by a dielectric constant of the fluid inside the fluid chamber functioning as the dielectric separating the pair of electrodes;
- starting a dosing cycle by dosing at least part of the fluid inside of the fluid chamber;
- starting a suction cycle, after at least partly dosing the fluid; and
- monitoring the fluid chamber by measuring a frequency of at least the first oscillator, and if detected, indicating of a gas build up inside the fluid chamber.

14. The method according to claim 13, further comprising the steps of measuring a frequency of a second oscillator, and storing the measured frequency of the second oscillator as a reference frequency.

15. The method according to claim 13, further comprising a degassing valve operatively connected to the fluid chamber.

16. The method of claim 13, wherein the pair of electrodes located outside the fluid chamber do not interfere with the flexure of the flexible wall.

17. The method of claim 13, wherein the pair of electrodes comprises a first electrode and a second electrode, and the pair of electrodes are positioned such that the electric field extends from the first electrode through a first portion of the rigid wall, from the first portion of the rigid wall through the fluid chamber, from the fluid chamber through a second portion of the rigid wall, and from the second portion of the rigid wall to the second electrode.

18. The method according to claim 13, further comprising the step of comparing the measured frequency with predefined threshold frequencies.

19. The method according to claim 18, wherein the frequency measured of the first oscillator varies periodically.

20. The method according to claim 19, further comprising, detecting the gas buildup if a frequency change occurs faster relative to the periodically varying frequency of the first oscillator.

* * * * *